US005778677A

United States Patent [19]

Hung et al.

[11] Patent Number: 5,778,677

[45] Date of Patent: Jul. 14, 1998

[54] DEVICE FOR MAKING ICE BLOCKS

[76] Inventors: Chichuan Hung; Shu-Fen Lee, both of 10th Fl-14, No. 186, Nanking E. Rd., Sec. 4, Taipei, Taiwan

[21] Appl. No.: 844,782

[22] Filed: Apr. 22, 1997

[51] Int. Cl.[6] ..... F25C 1/04

[52] U.S. Cl. ..... 62/3.63; 62/137

[58] Field of Search ..... 62/3.63, 3.64, 62/135, 340; 222/465.1

[56] References Cited

U.S. PATENT DOCUMENTS 4,055,053 10/1977 Elfving et al. ..... 62/3.63

5,388,729 2/1995 Gerringer ..... 222/465.1

5,560,211 10/1996 Parker ..... 62/3.63

FOREIGN PATENT DOCUMENTS 1351990 12/1963 France ..... 62/3.63

*Primary Examiner*—William E. Tapoicai

*Attorney, Agent, or Firm*—Bacon & Thomas

[57] ABSTRACT

Ice blocks are formed in multiple compartments of a board disposed at the bottom of a water-filled housing by a powered cooling chip having a cold interface attached to a cooling seat below the board and a hot interface attached to a heat radiating plate.

3 Claims, 3 Drawing Sheets

DEVICE FOR MAKING ICE BLOCKS

BACKGROUND OF THE INVENTION

The present invention relates to a cooling type ice block making device in which a cooling chip is disposed under a cooling seat with the cold interface attached to the bottom of the cooling seat. A checker-like partitioning board is disposed on the cooling seat, having multiple compartments for making ice blocks. The low temperature of the cooling chip is directly transmitted from the bottom of the cooling seat to the upper side thereof to condense the water in the compartments into ice blocks. After the power for the cooling chip is cut off, the edges of the ice blocks quickly melt, permitting the ice blocks to automatically float upward.

Ice blocks are often added into a beverage for keeping the beverage at a low temperature. The ice blocks are generally made by a separate ice block making device such as a refrigerator. Accordingly, it is necessary to first take out the ice blocks and then place the ice blocks into the beverage before serving. This is neither convenient nor hygienic.

Moreover, the conventional refrigerator or ice maker employs a compressor to compress coolant into a high pressure state to flow into a condensor. The condensor radiates the heat absorbed by the coolant and a fan is used to exhaust the heat of the condensor. After the heat is radiated, the coolant flows through the coolant tube into an evaporating winding tube of an ice water container. The high pressure coolant expands and absorb the heat in the winding tube, making the water around the winding tube abruptly cooled. The expanded coolant then circulates flows from the winding tube back to the compressor to form a circulation. By means of such heat-absorption during expansion of the coolant, the heat of the water is absorbed and the temperature of the water in the container is decreased to form ice blocks. The above method for making ice blocks is expensive. Also, it is impossible to readily make ice blocks for a single bottle of beverage.

SUMMARY OF THE INVENTION

It is therefore a primary object of the present invention to provide a cooling type ice block making device in which a cooling chip is disposed under a cooling seat with the cold interface attached to the bottom of the cooling seat. A checker-like partitioning board is disposed on the cooling seat, with the board having multiple compartments for making ice blocks. The low temperature of the cooling chip is directly transmitted from the bottom of the cooling seat to the upper side thereof to condense the water in the compartments into ice blocks. The heat produced from the hot interface of the cooling chip is radiated by a heat-radiating fan via a heat-radiating plate. Accordingly, the ice blocks are directly formed in the housing of the container and it is no longer necessary to externally add ice blocks into the container. Therefore, the requirements of both convenience and hygiene are satisfied.

It is a further object of the present invention to provide an ice block making device in which the cooling chip achieves the cooling effect without using any compressor or coolant pipeline so that energy is saved and the problem of coolant leakage is avoided.

The present invention can be best understood through the following description and accompanying drawings, wherein:

DETAILED DESCRIPTION OF THE PREFERRED EMBODIMENT

Figures 1A, 1B:
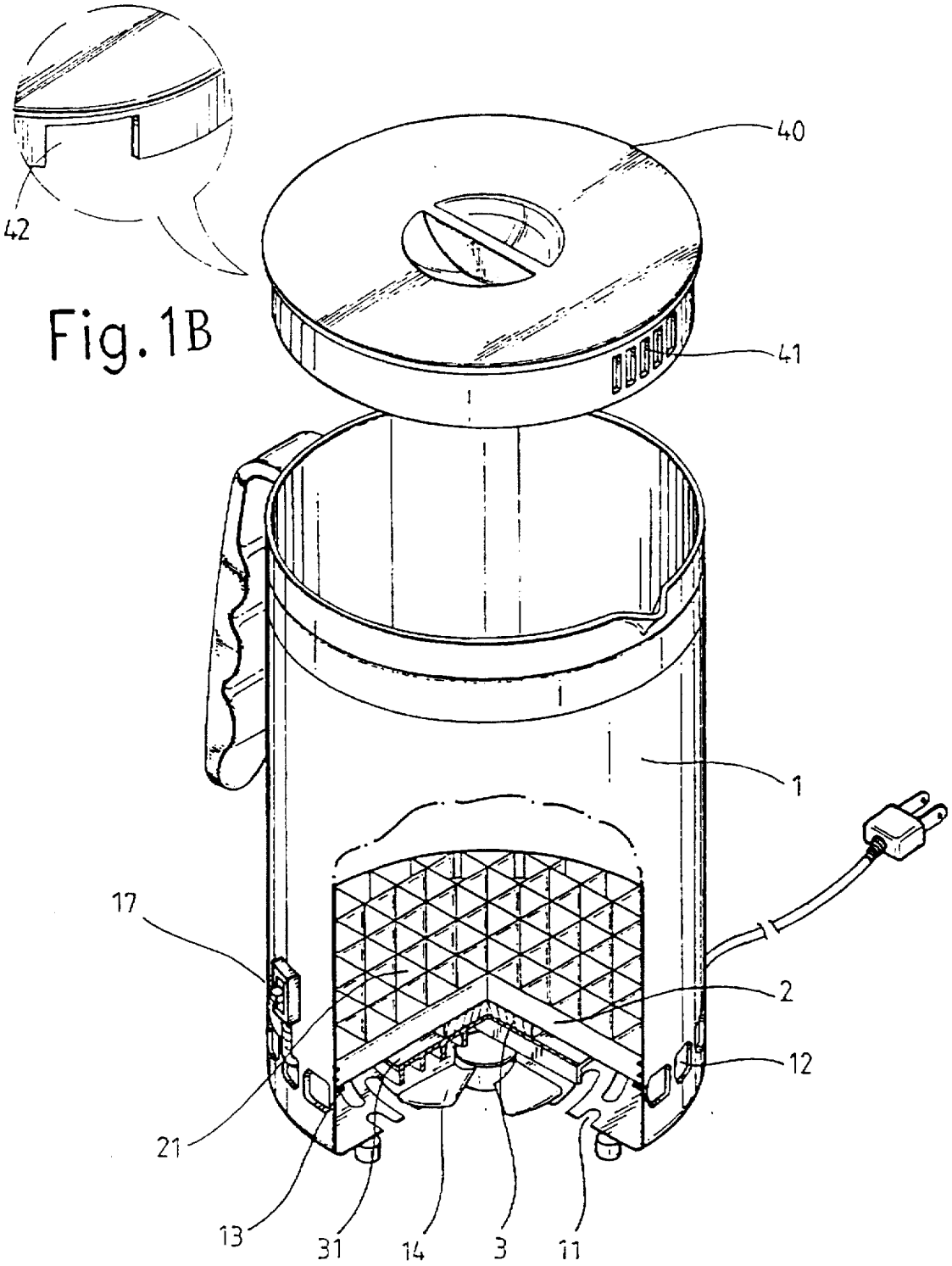
FIGS. 1A and 1B are perspective partially sectional views of the present invention.
Figure 2:
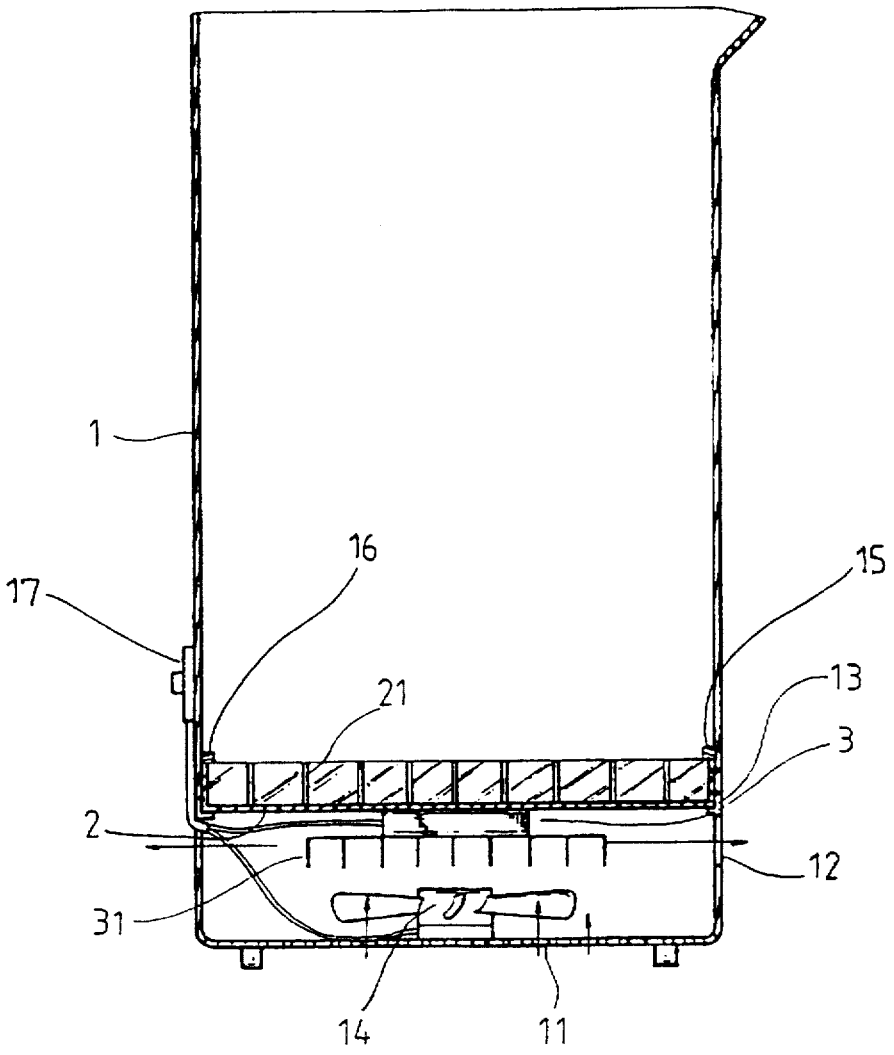
FIG. 2 is an assembled sectional view of the present invention.

Please refer to FIGS. 1A, 1B and 2. The present invention mainly includes a housing 1, a cooling seat 2, a cooling chip 3 and an upper cover 40. A power switch 17 is disposed on the outer side of the housing 1. A heat-radiating fan 14 is disposed at the center of a bottom portion of the housing 1. Multiple air outlets 12 are formed in a lower sidewall of the housing 1 beside the fan 14, while multiple air inlets 11 are formed in the bottom of the housing 1. An inner flange 13 is formed above the air outlets 12 for placing the cooling seat 2 thereon. A checker-like partitioning board 21 having a predetermined height is disposed above the cooling seat 2, with board 21 having multiple compartments. The cold interface of the cooling chip 3 is attached to the lower side of the cooling seat 2, while the hot interface thereof is attached to a heat-radiating plate 31 disposed above the fan 14. The cooling chip 3 and the fan 14 are electrically connected with the power switch 17 via wires.

Figure 3:
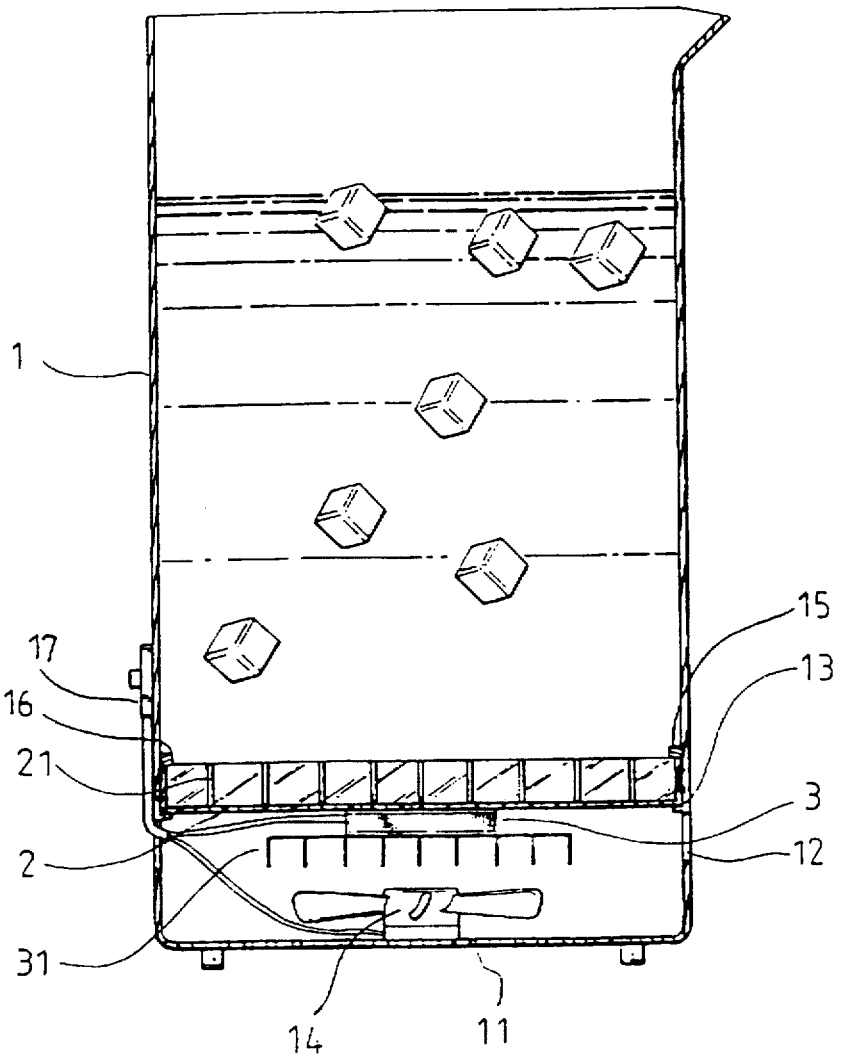
FIG. 3 shows the application of the present invention.

Referring to FIG. 3, after the housing 1 or the compartments of the partitioning board 21 are filled with water, the cooling chip 3 is powered on to decrease the temperature of the cold interface. At this time, the low temperature is transmitted from the bottom of the cooling seat 2 to the upper side thereof so that the water in the compartments of the partitioning board 21 is condensed into ice blocks. The heat produced from the hot interface of the cooling chip 3 is conducted to the heat-radiating plate 31 which is blown by the fan 14 to decrease the temperature. At this time, the user can cut off the power for the cooling chip 3, whereby the edges of the ice blocks in the compartments of the partitioning board 21 will be immersed in the water and quickly melt. Thereafter, the ice blocks will be released from the compartments of board 21 and float in the water to form a cold drink with ice blocks.

After cutting off the power for the cooling chip 3, the speed of melting edges edges of the ice blocks can be increased by reversing the power switch 17 to interchange the cold and hot interfaces of the cooling chip 3. Accordingly, the high temperature is transmitted from the bottom of the cooling seat 2 to the upper side thereof to speed the melting of the edges of the ice blocks.

The upper cover 40 is disposed at the top of the housing 1 to close the opening thereof. The upper cover 40 is formed with a screen 41 for serving ice water and an open window 42 for serving the ice blocks.

In addition, a temperature controlling switch 15 and a water level switch 16 are disposed on the housing 1 near the cooling seat 2, whereby in the event too low a temperature is realized or water level is too low, the cooling chip 3 is powered off so as to avoid over-operation of the cooling chip.

It should be noted that the above description and accompanying drawings are only used to illustrate one embodiment of the present invention, and not intended to limit the scope thereof. Any modification of the embodiment should fall within the scope of the present invention.

What is claimed is:

1. A device for making ice blocks comprising:

a) a housing for containing water, the housing including a lower side wall portion and a bottom, a plurality of air outlets formed in the lower side wall portion, a plurality of air inlets formed in the bottom, and an inner flange positioned above the air outlets;

b) a cooling seat supported on the inner flange, the cooling seat including a lower side;

c) a partitioning board disposed above the cooling seat, the partitioning board including a plurality of compartments for receiving water therein;

d) a heat-radiating fan within a bottom portion of the housing;

e) a heat-radiating plate positioned above the fan;

f) a cooling chip having a cold inner face attached to the lower side of the cooling seat and a hot inner face attached to the heat-radiating plate;

g) a power switch disposed on an outer side of the housing, the power switch being in electrical connection to the cooling chip and the fan for actuating same; and h) a water level switch disposed in the housing for detecting the water level in the housing and controlling the operation of the cooling chip.

2. The device of claim 1 wherein the housing further includes a top opening, an upper cover for closing the top opening, and the upper cover having a screen for serving ice water and an open window for serving ice blocks.

3. The device of claim 1 further including a temperature controlling switch disposed on the housing adjacent the cooling seat for detecting the temperature of the water in the housing and controlling the operation of the cooling chip.

* * * * *